United States Patent [19]

Bright

[11] 4,322,603

[45] Mar. 30, 1982

[54] ELECTRODE STEAM GENERATOR SYSTEM FOR SECONDARY OIL RECOVERY

[75] Inventor: George L. Bright, Irvine, Calif.

[73] Assignee: American Resources Corporation Ltd., British Virgin Isls.

[21] Appl. No.: 130,468

[22] Filed: Mar. 14, 1980

[51] Int. Cl.[3] ..... H05B 3/60; F22B 1/30; E21B 36/00; E21B 43/24

[52] U.S. Cl. ..... 219/278; 166/57; 166/272; 166/303; 219/273; 219/289; 219/292

[58] Field of Search ..... 219/284–295, 219/271–276, 277, 278; 166/57, 302, 303, 272

[56] References Cited

U.S. PATENT DOCUMENTS

| | | | |
|---|---|---|---|
| 570,790 | 11/1896 | Gainnie | 219/284 X |
| 902,016 | 10/1908 | Stott | 219/284 X |
| 1,184,200 | 5/1916 | Nash | 219/292 |
| 1,327,774 | 1/1920 | Plante | 219/291 X |
| 1,565,574 | 12/1925 | Larsen | 166/302 |
| 1,658,697 | 2/1928 | Weisman | 166/57 |
| 1,665,793 | 4/1928 | Sandborgh | 219/286 |
| 2,355,687 | 8/1944 | van Hise | 219/284 X |
| 2,451,594 | 10/1948 | Watson | 219/292 |
| 2,572,337 | 10/1951 | Harris | 219/285 |
| 2,724,045 | 11/1955 | Bates | 219/289 |
| 2,790,890 | 4/1957 | Kasuga | 219/287 |
| 2,792,487 | 5/1957 | Minier | 219/288 |
| 2,821,614 | 1/1958 | Jansons | 219/288 X |
| 2,902,580 | 9/1959 | Lowe et al. | 219/292 |
| 3,104,308 | 9/1963 | Wilson | 219/285 |
| 3,396,792 | 8/1968 | Muggee | 166/303 |
| 3,420,301 | 1/1969 | Riley et al. | 219/292 X |
| 3,980,137 | 9/1976 | Gray | 166/303 |

FOREIGN PATENT DOCUMENTS

| | | | |
|---|---|---|---|
| 345365 | 12/1936 | Italy | 219/285 |
| 92351 | 1/1922 | Switzerland | 219/292 |

*Primary Examiner*—A. Bartis

[57] ABSTRACT

A system for supplying steam to a well casing for secondary oil recovery from an oil well includes an individual electric steam generator unit positioned at the ground surface adjacent each well head. The steam generator includes an electrode assembly comprising a pair of concentrically spaced cylindrical electrodes positioned between a pair of electrically insulative end plates and mounted within a cylindrical, closed-end electrically insulative housing by electrically conductive rods extending through the respective electrodes and the end plates and secured to one end of the housing. The end plates are spaced from the ends of the housing to form a water inlet space at one end of the housing and a steam outlet space at the other end. Apertures in the end plates communicate the water inlet space and steam outlet space with the space between the electrodes. The apertures communicating the steam outlet space may be skewed to provide a turbulent flow of steam into the steam outlet space. The rods serve to connect the electrodes to a source of power. Water is supplied to the water inlet space by a pump through a filter and water control valve. The flow of steam from the steam space is controlled by a valve in a steam line leading to the well head.

2 Claims, 3 Drawing Figures

ELECTRODE STEAM GENERATOR SYSTEM FOR SECONDARY OIL RECOVERY

BACKGROUND OF THE INVENTION

This invention relates to a system for secondary oil recovery from an oil well. For some time, additional oil has been recovered from an oil well by introducing steam into the oil bearing formation. The usual practice is to provide a large oil fired steam oiler at a central location in an oil field and run steam through pipes along the ground to the various wells in the field. This type of system requires a substantial investment in the boiler and piping and hence is not economically satisfactory for small fields with widely spaced wells or individual wells. Also, the boilers normally burn some form of refined fuel oil rather than crude, which fuel oil must be transported to the boiler site.

An alternative configuration is suggested in U.S. Pat. No. 3,420,301 with an electrically energized heater positioned in the well casing near the oil bearing formation. The heater incorporates concentric electrodes with a space therebetween for fluid flow, and a central passage through the inner electrode for the sucker rod. This arrangement has not proved satisfactory because of the problems of placing the heater down in the well and the problems on recovering the heater when it malfunctions or for maintenance.

It is an object of the present invention to provide a new and improved system for secondary oil recovery which overcomes these disadvantages. A further object is to provide a small self contained system suitable for positioning and operation at the surface and for utilization with a single well. It is a particular object to provide such a system which may be easily and continuously monitored during operation and one which is readily accessbile for adjustment during operation and for maintenance. Another object is to provide a system which does not produce any air pollutants and which does not require any special permit for its operation.

Other objects, advantages, features and results will more fully appear in the course of the following description.

SUMMARY OF THE INVENTION

The system of the invention provides for secondary oil recovery from an oil well having a casing extending to the earth's surface. This system includes an electrically energized steam generator unit having a water inlet and a steam outlet, means for connecting an electric power supply to the generator unit, a water pump having an inlet and an outlet, means for connecting a water source to the pump inlet, and means for connecting the pump outlet to the generator unit inlet and for connecting the generator unit outlet to the casing at the well head. The steam generator unit includes concentric electrodes with an annular flow space therebetween, with an electric power supply connected across the electrodes. The electrodes are mounted in an electrical insulating housing which provides for flow of water from the pump through the housing into the space between the electrodes, with steam flowing from the housing to the well head. In the preferred configuration, operation of the system is controlled by controlling flow of steam from the generator unit without requiring control of the electrical supply.

DESCRIPTION OF THE PREFERRED EMBODIMENT

Figure 1:
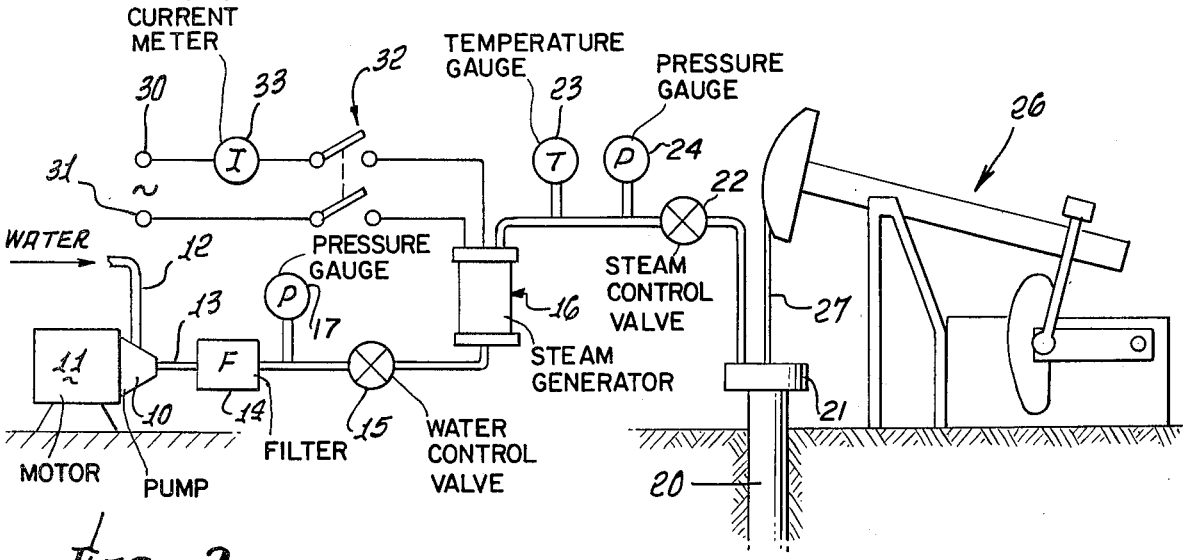
FIG. 1 is a diagram illustrating a system for secondary oil recovery and incorporating the presently preferred embodiment of the invention.

The system as illustrated in FIG. 1 includes a water pump 10 typically driven by an electric motor 11, with a water inlet line 12 and an outlet line 13. Water from the pump flows through a filter 14 and a control valve 15 to a steam generator unit 16. A water pressure gauge 17 is connected in the line between the pump and generator unit.

Steam from the generator unit 16 is directed to the well casing 20 at the well head 21 through a control valve 22. A steam temperature gauge 23 and a steam pressure gauge 24 are connected in the line between the generator unit 16 and the valve 22. The steam line preferably is wrapped with insulation to reduce heat loss. Also, the generator unit 16 preferably is placed as close as possible to the well head 21 in order to reduce heat loss. A conventional pumping rig 26 drives a sucker rod 27 which also passes down the casing, for pumping oil to the surface in the conventional manner.

An electric power source is connected at terminals 30, 31 and is connected through switch 32 to the generator unit 16. A current meter 33 is positioned in one of the lines between the source and the generator unit.

Figure 2:
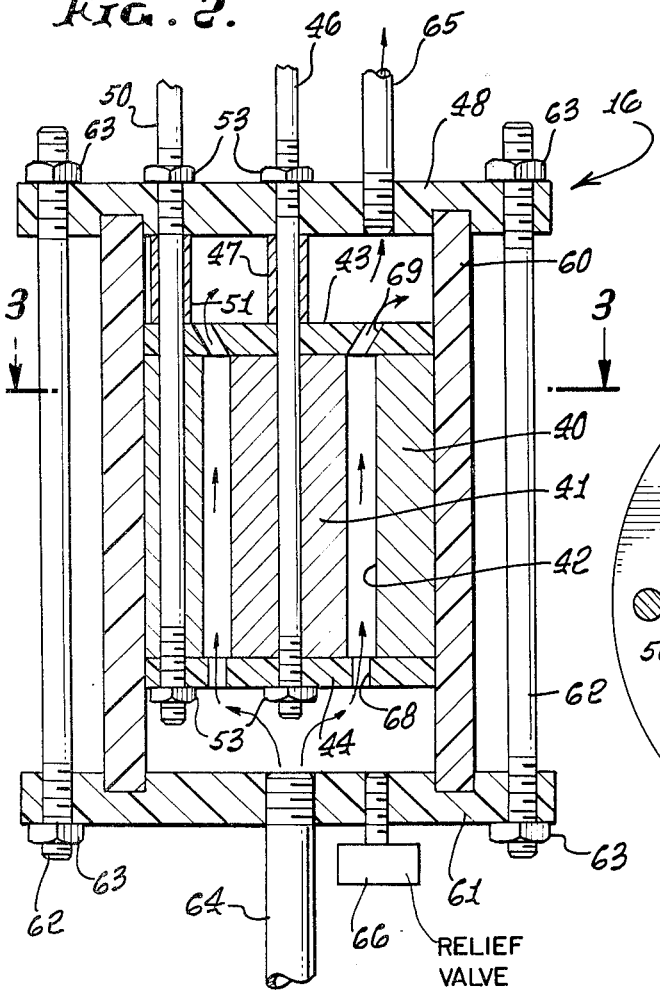
FIG. 2 is a vertical sectional view through a steam generator unit suitable for use in a system of FIG. 1.
Figure 3:
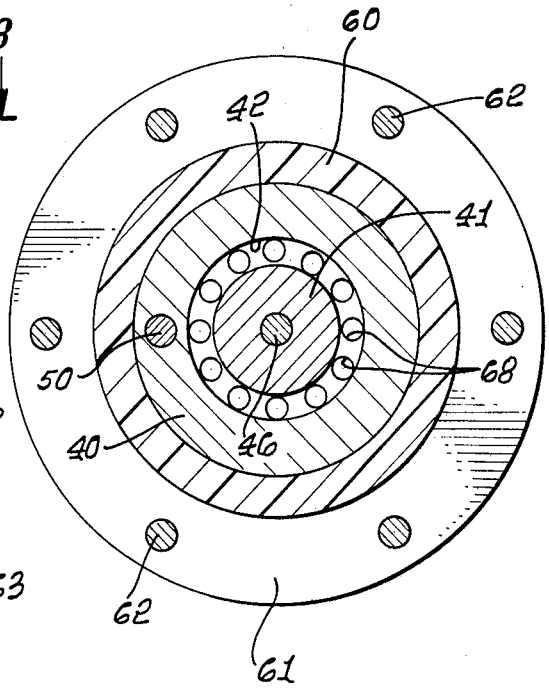
FIG. 3 is a sectional view taken along the line 3—3 of FIG. 2.

A preferred form for the steam generator unit 16 is shown in FIGS. 2 and 3.

A tubular electrode 40 is concentrically positioned about a cylindrical electrode 41, with an annular flow passage 42 therebetween. The electrodes are made of electrical conducting material, such as carbon, copper, brass, aluminum, and the like. End plates 43, 44 are positioned at each end of the electrodes and are made of a high temperature high pressure resistant plastic such as rytonite. An electrical conducting rod 46 is passed through a central opening in the end plate 44, the electrode 41, the end plate 43, and insulating sleeve 47, and an end cap 48. A similar rod 50 is passed through aligned openings in the end plate 44, the electrode 40, the end plate 43, sleeve 51, and the end cap 48. These components are clamped together by nuts 53 threaded onto the rods, as illustrated. The rods 46, 50 provide for electrical connections to the respective electrodes, and are connected to the switch 32.

A sleeve 60 is slide over the end plates and electrodes, preferably being a press fit, and the upper end of the sleeve preferably engages a circular groove in the end cap 48. A similar end cap 61 is positioned at the lower end of the sleeve 60 and the end caps and sleeve 60 are clamped together by rods 62 and nuts 63. A water inlet line 64 is connected in the end cap 61, and a steam outlet line 65 is connected in the end cap 48. A pressure relief valve 66 is also mounted in the end cap 61. The sleeve 60 and the end caps 48, 61 also are made of a high temperature high pressure resistant plastic such as Rytonite, a polyphenylene sulfide, which is sold by Phillips Petroleum under the tradename Ryton.

A plurality of openings 68 is provided in the end plate 44, and another plurality of openings 69 is provided in the end plate 43. The openings 69 preferably are skewed so as to produce a turbulent motion of the steam in the space between the plate 43 and the cap 48.

In operation, water is provided at the inlet line 12 and the pump 10 is operated to pump water into the generator unit 16. The switch 32 is closed to electrically energize the generator unit. Water enters the unit through line 64 and flows through the openings 68 into the space between the electrodes, where the water is converted into steam. The steam leaves through the openings 69 and the outlet line 65 and flows into the well casing. In a typical generator unit, the overall unit is about six inches outside diameter and sixteen inches long. The inner electrode is in the order of 1½ inches outside diameter and 12 inches long. The outer electrode is in the order of 4¼ inches outside diameter and 12 inches long, with the gap between the electrodes about ¼ inch.

The electrodes may be directly connected to a 480 volt AC supply, with the current drawn being controlled by controlling the flow through the generator unit. Typically water is provided at a rate of about 0.7 to 0.9 gallons per minute providing steam in the range of 300°–350° F. at about 120 pounds per square inch through a half inch outlet line. With this operation, the current is about 30–35 amperes. The steam pressure can be controlled by means of the valve 22 to achieve the desired operating range. The water flow can also be controlled by means of the control valve 15.

After adjusting the parameters to achieve the desired steam pressure and temperature and current consumption, the system may be operated continuously providing steam down the well casing. The system is small and compact, is readily installed on the surface at a well head and is readily moved from one location to another as desired. The various components of this system are easily accessible for routine maintenance and for trouble shooting if necessary.

I claim:

1. In a ground level system for secondary oil recovery from an oil well having a casing extending to the earth's surface, the combination of:

an electrically energized steam generator unit positioned at the surface, said unit including spaced concentric electrodes with an annular flow passage therebetween, and a housing enclosing said electrodes, said housing having a water inlet for supplying water to said flow passage and a steam outlet for receiving steam from said flow passage;

first means for connecting an electric power supply to said electrodes;

a water pump having an inlet and an outlet;

second means for connecting a water source to said pump inlet;

third means for connecting said pump outlet to said generator unit water inlet;

fourth means for connecting said generator unit steam outlet to a well casing at the surface; and means for controlling water flow from said pump to said generator unit and means for controlling steam flow from said generator unit to said casing for controlling steam pressure without requiring control of electric current and voltage;

said generator unit including:

first and second end plates of electrical insulating material positioned at opposite ends of said electrodes;

an open-ended sleeve of electrical insulating material positioned around said electrodes and plates;

first and second end caps of electrical insulating material positioned at opposite ends of said sleeve with said water inlet being provided in said first end cap and said water outlet being provided in said second end cap;

means for clamping said end caps and sleeve together to form said housing;

means for clamping said first end plate, electrodes, second end plate and second cap together, including a first electrical conducting rod passing through said first plate, the outer of said electrodes, said second plate and said second cap, and a second electrical conducting rod passing through said first plate, the inner of said electrodes, said second plate and said second cap, and first and second electrically insulative spacers about said rods between said second plate and second cap with said clamping means compressing together said first plate, first and second electrodes, second plate, first and second spacers, and second cap, without other components or gaps therebetween, with said second end plate spaced from said second end cap by said spacers to define a steam outlet space and with said first plate spaced from said first cap to define a water inlet space, said rods forming said first means for connecting an electric power source to said electrodes;

each of said plates having a plurality of openings therethrough defining flow paths from said water inlet space through said first plate, said annular passage, and said second plate to said steam outlet space.

2. A steam generator unit for a system for secondary oil recovery and including in combination:

spaced concentric electrodes with an annular flow passage therebetween;

first and second end plates of electrical insulating material positioned at opposite ends of said electrodes in direct engagement with said electrodes;

an open-ended sleeve of electrical insulating material positioned around said electrodes and plates;

first and second end caps of electrical insulating material positioned at opposite ends of said sleeve;

means for clamping said end caps and sleeve together to form a housing enclosing said electrodes;

means for clamping said first end plate, electrodes, second end plate, and second cap together, including a first electrical conducting rod passing through said first plate, the outer of said electrodes, said second plate and said second cap, and a second electrical conducting rod passing through said first plate, the inner of said electrodes, said second plate and said second cap, and first and second electrically insulative spacers about said rods between said second plate and second cap, with said clamping means compressing together said first plate, first and second electrodes, second plate, first and second spacers, and second cap, without other components or gaps therebetween, with said first plate spaced from said first end cap to define a water inlet space and said second plate spaced from said second end cap by said spacers to define a stream outlet space, said rods being adapted to connect said electrodes to a power source;

said first cap having a water inlet;

said second cap having a steam outlet;

each of said plates having a plurality of openings therethrough defining flow paths from said water inlet through said first plate, said annular passage, and said second plate to said steam outlet, with said openings in said second plate skewed relative to the axis of said annular flow passage to provide a turbulent flow of steam in the space defined by said first and second spacers between said second plate and said second cap.

* * * * *